US006088919A

United States Patent [19]

Gilman

[11] Patent Number: 6,088,919

[45] Date of Patent: Jul. 18, 2000

[54] NAIL CLIPPER RETAINER

[76] Inventor: Gary Duane Gilman, 1510 S. Utica St., Denver, Colo. 80219

[21] Appl. No.: 09/069,137

[22] Filed: Apr. 29, 1998

[51] Int. Cl.[7] ..... A45D 29/02

[52] U.S. Cl. ..... 30/28; 132/75.5

[58] Field of Search ..... 30/28; 132/75.5, 132/75.4, 75

[56] References Cited

U.S. PATENT DOCUMENTS

| | | | |
|---|---|---|---|
| 3,744,131 | 7/1973 | Manes . | |
| 4,550,496 | 11/1985 | Reinicke | 30/28 X |
| 4,856,190 | 8/1989 | Reiswig . | |
| 4,903,514 | 2/1990 | Jung . | |
| 5,010,644 | 4/1991 | Goench . | |
| 5,074,041 | 12/1991 | Wagner . | |
| 5,131,146 | 7/1992 | Leininger . | |
| 5,150,521 | 9/1992 | Han | 30/28 |

*Primary Examiner*—Douglas D. Watts
*Attorney, Agent, or Firm*—R. William Graham

[57] ABSTRACT

A nail clipper retainer for use with a convention nail clipper having jaws fixed together at a first end and having chain hole surfaces therein and chain connected thereto, a rivet slidably connected to rivet open surfaces formed in a second end of the nail clipper jaws and a lever actuatably connected at a first end of the lever to the rivet to enable the jaws to bite together at the second end of the nail clipper, wherein the nail clipper retainer includes a hollow housing of a size and configuration to generally receive the nail clipper therein, the housing having a base, sides and top, wherein the base and sides of the housing are a sufficient length to substantially extend a length of the nail clipper, a first end having a chain open surface for receiving the chain of the nail clipper therethrough and a second end having an opening in the top sufficient to permit actuation of the lever and jaws of the clipper and permit access of the jaws. The housing is generally flexible and includes a pair of protruding guide members on the top thereof to enable a second end of the lever to seat there between. Also, ribbed gripping surfaces laterally extend from each side of the first end of the nail clipper retainer.

6 Claims, 2 Drawing Sheets

NAIL CLIPPER RETAINER

BACKGROUND OF THE INVENTION

1. Field of the Invention

The present invention relates generally to the field of personal hygiene devices. More particularly, the present invention relates to a device for the retention of a nail clipper and nail clippings.

2. Related Art

In the field of personal hygiene, there have long existed nail trimming devices which are commonly referred to as nail clippers. A typical nail clipper will include a couple of metal jaws which are rigidly connected at one end and spaced at their biting end with the ability to be leveraged toward one another by a lever in order to perfect a bite and cutting action on one's nail. The non-biting end also typically includes a chain hole surface through which a chain passes to enable the nail clipper to be fastened to a key ring or the like.

While the nail clipper has enjoyed marked success with its design over the years, it has at least one undesirable attribute. Namely, the nail clipper's design does not provide for the retention of the nail clippings. Accordingly, attempts have been made over the years to provide retrofit devices for cooperation with the nail clipper in order to catch and retain nail clippings.

While some of these retrofit devices have met with some success, more often than not, such devices have not either been used or were ineffective in the market. Thus, there remains a need for an improved nail clipping retention device.

BRIEF SUMMARY OF THE INVENTION

It is an object of the present invention to improve personal hygiene.

It is yet another object to improve nail clipping devices.

It is still another object to retrofit a conventional nail clipper with an improved nail clipping retention device.

It is another object to retain a nail clipper in a readily removable retainer.

Accordingly, the present invention is directed to a nail clipper retainer for use with a convention nail clipper. The clipper has jaws which are fixed together at a first end and has chain hole surfaces in such ends with a chain connected thereto. A rivet is slidably connected to rivet open surfaces formed in a second end of the nail clipper jaws and a lever is actuatably connected at its first end to the rivet to enable the jaws to be leveraged together to form a bite.

The nail clipper retainer includes a hollow housing of a size and configuration to generally receive the nail clipper therein. The housing has a base, sides and a top, wherein the base and sides of the housing are a sufficient length to substantially extend a length of the nail clipper. A first end of the retainer has a chain open surface, preferably two, for receiving the chain of the nail clipper therethrough and a second end having an opening in the top sufficient to permit actuation of the lever and jaws of the clipper and permit access of the jaws. The housing is generally flexible and includes a pair of protruding guide members on the top thereof to enable a second end of the lever to seat therebetween. Also, ribbed gripping surfaces laterally extend from each side of the first end of the nail clipper retainer to aid in the removal of the retainer.

Other objects and advantages will be readily apparent to those skilled in the art upon viewing the drawings and reading the detailed description hereafter.

DETAILED DESCRIPTION OF THE INVENTION

Figure 1:
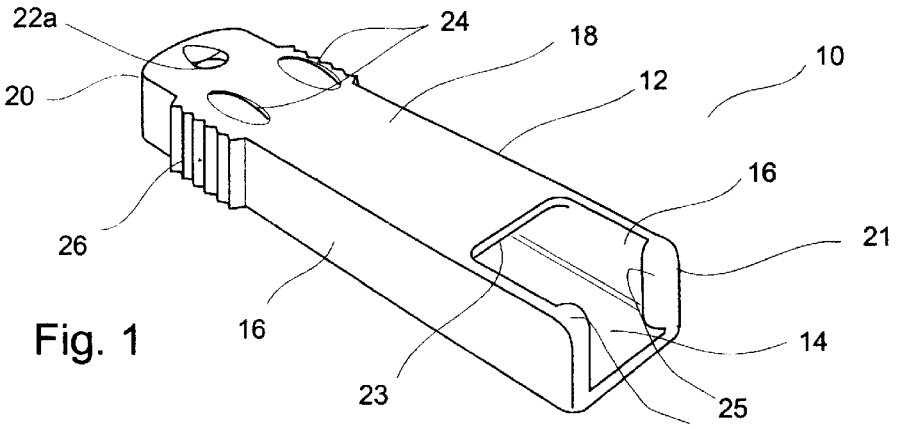
FIG. 1 is a perspective view of the nail clipper retainer of the present invention.
Figure 2:
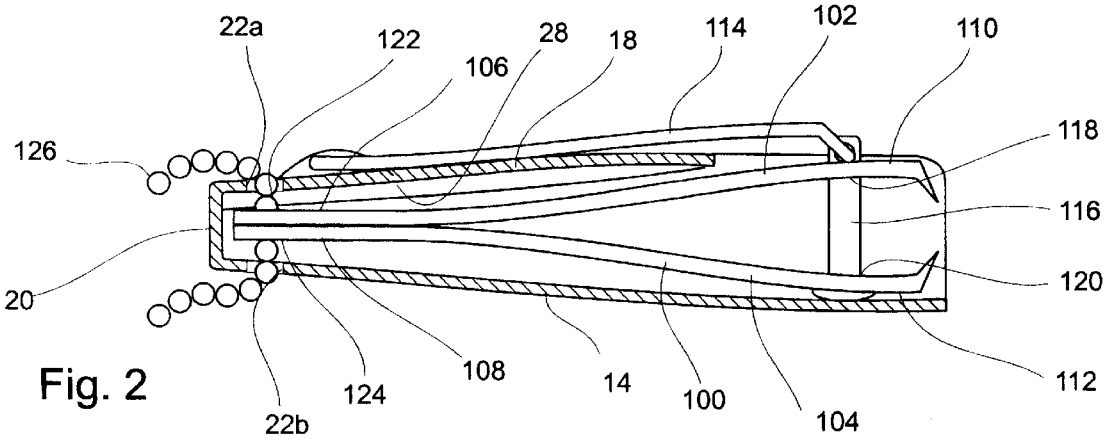
FIG. 2 is a cross sectional view of the nail clipper retainer of the present invention with a nail clipper therein.
Figure 3:
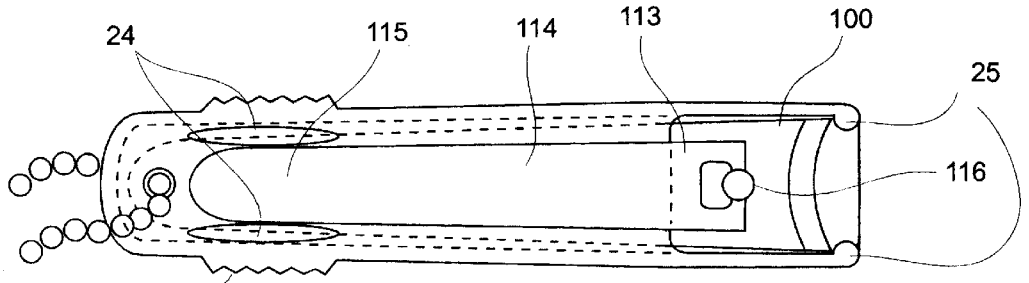
FIG. 3 is a top view of the nail clipper retainer of the present invention with a nail clipper therein.
Figure 4:
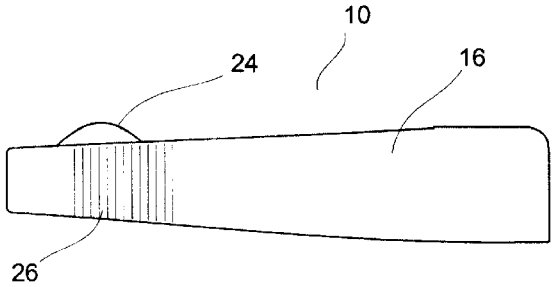
FIG. 4 is a side view of the nail clipper retainer of the present invention.

Referring now to the present invention as shown in FIGS. 1–8, the nail clipper retainer is generally designated by the numeral 10. The nail clipper retainer 10 includes a generally hollow housing 12. The housing 12 has a base 14, sides 16, and top 18. In the preferred embodiment, the housing 12 is made of a flexible polymer material which is slightly tapered being wider at end 21 and narrower at end 20 to more readily enable it to be squeezed in a manner to remove a nail clipper 100 therefrom.

The nail clipper retainer 10 includes in end 20 a chain open surface 22*a* in the top 18 and another chain open surface 22*b* in the base 14. The chain open surfaces 22*a* and 22*b* are preferably arranged opposite and coaxial from one another, but may be arranged in other manners to accomplish an aspect of the invention.

Figure 6:
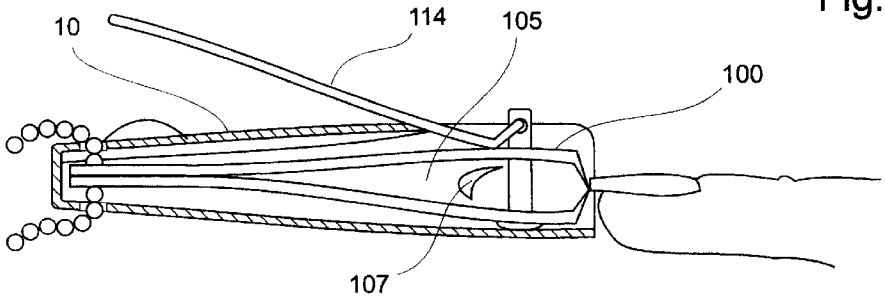
FIG. 6 is a cross sectional view of the nail clipper retainer of the present invention with a nail clipper therein in an operative mode.

The nail clipper 100 includes a pair of arcuate jaws 102 and 104 which are rigidly connected at ends 106 and 108, respectively, and spaced at their ends 110 and 112, respectively. The ends 110 and 112 form the biting end with the ability to be leveraged toward one another by a lever 114 which is operably pivotally connected at one end 113 to a rivet 116 which is slidably connected to the ends 110 and 112 at rivet open surfaces 118 and 120, respectively. As seen in FIG. 6, this enables the jaws 102 and 104 to perfect a bite and cutting action on one's nail. The ends 106 and 108 include chain hole surfaces 122 and 124, respectively, therethrough which are oriented adjacent one another and are coaxially alignable with chain hole surfaces 22*a* and 22*b*. A chain 126 passes through the chain hole surfaces chain hole surfaces 22*a* and 22*b* and 122 and 124 to enable the nail clipper 100 to be to fastened to the retainer 10 and a key ring or the like.

The housing 12 has another end 21 having an open surface 23 in the top sufficient to permit actuation of the lever 114 and the jaws 102 and 104 of the clipper 100 and permit access of the bite of the jaws, 102 and 104 as seen in FIG. 6. Integrally connected to the sides 16 at end 21 are a pair of protruding retaining bumpers 25 which aid in the retention of the clipper 100. The sides 16 of the housing 12 together with the jaws 102 and 104 form a retainer area 105 for the nail clippings 107.

Figure 5:
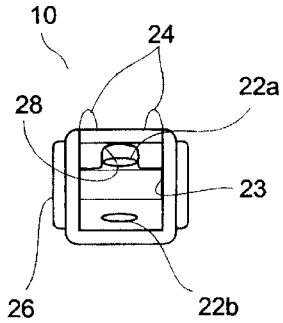
FIG. 5 is an end view of the nail clipper retainer of the present invention.
Figure 7:
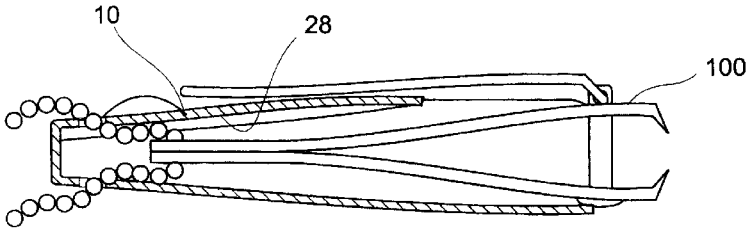
FIG. 7 is a cross sectional view of the nail clipper retainer of the present invention with a nail clipper therein showing the removal of the clipper.

The housing 12 includes a pair of protruding guide members 24 which are preferably integrally formed on the top 18 adjacent end 20 to enable a second end 115 of the lever 114 to seat therebetween. Also, ribbed gripping surfaces 26 laterally extend from each side 16 adjacent the end 20 of the nail clipper retainer 10 and are likewise preferably integrally formed. FIGS. 5 and 7 depict another preferred embodiment wherein a longitudinally extending grooved surface 28 is formed in an underside of the top 18 which acts as a guide for the chain 126 as it is pulled through the retainer 10.

Figure 8:
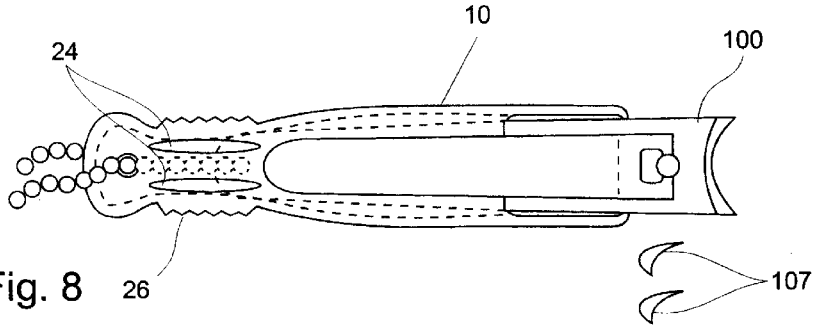
FIG. 8 is a view from the top of the nail clipper retainer when turned on its side of the present invention with a nail clipper therein being ejected to permit nail clippings to be removed.

The nail clipper retainer 10 of present invention provides for an improved device which retains nail clippings in its housing 12 until proper disposal thereof is made for example into a waste receptacle. At this point, the ribbed gripping surfaces 26 are pinched and in conjunction with the tapered configuration of the housing 12 and pulling on the lever 114 cause the ejection of the nail clipper 100. Once the jaws 102 and 104 have sufficiently departed from the sides 16 of the retainer 10, the nail clippings 107 are free to fall out as seen in FIG. 8. The nail clipper 100 may then be easily reseated into the retainer by simply pulling on the chain 126 while holding the nail clipper retainer 10.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A nail clipper retainer for use with a convention nail clipper, wherein the nail clipper has a pair of jaws which are fixed together at a first end and have chain hole surfaces in the first end with a chain extending through said chain hole surfaces and having two interconnectable ends, a rivet slidably connected to rivet open surfaces formed in a second end of the jaws and a lever actuatably pivotally connected at a first end to the rivet to enable the jaws to be leveraged together to form a bite, wherein said nail clipper retainer included:

a hollow housing having a base, sides connected to the base and a top connected to said sides, wherein said base and said sides of said housing are a sufficient length to substantially extend a length of the nail clipper, a first end interconnecting said top, said base and said sides of said retainer and wherein said top and said base each has a chain open surface adjacent said first end for receiving the chain therethrough and a second end having an opening in said top sufficient to permit actuation of the lever and the jaws of the clipper and permit access of the jaws, wherein said housing is of a size and configuration to generally slidably receive the nail clipper and chain therein, said housing being further characterized to include a retention bumper connected at said second end to aid in retaining the clipper such that nail clippings are prevented from escaping between said second end of said retainer and the jaws of the nail clipper when the nail clipper is disposed within said retainer.

2. The nail clipper retainer of claim 1, wherein said housing includes a grooved surface which is formed inside said housing to slidably receive the chain as the clipper is axially moved within said retainer.

3. The nail clipper retainer of claim 1, wherein said housing is further characterized to include a pair of retention bumpers, wherein one of said bumpers is connected to one of said sides at said second end and another of said bumpers is connected to another of said sides at said second end to aid in retaining the clipper and nail clippings from escaping between said bumpers and the jaws of the nail clipper when the nail clipper is disposed within said retainer.

4. A nail clipper retainer for use with a conventional nail clipper, wherein the nail clipper has a pair of jaws which are fixed together at a first end and have chain hole surfaces in the first end with a chain extending through said chain hole surfaces and having two interconnectable ends connected therethrough, a rivet slidably connected to rivet open surfaces formed in a second end of the jaws and a lever actuatably pivotally connected at a first end to the rivet to enable the jaws to be leveraged together to form a bite, wherein said nail clipper retainer includes:

a hollow flexible housing having a base, sides connected to the base and a top connected to said sides, wherein said base and said sides of said housing are a sufficient length to substantially extend a length of the nail clipper, a first end interconnecting said top, said base and said sides of said retainer and wherein said top and said base each has a chain open surface adjacent said first end for receiving the chain therethrough and a second end having an opening in said top sufficient to permit actuation of the lever and the jaws of the clipper and permit access of the jaws, wherein said housing is of a size and configuration to generally slidably receive the nail clipper and chain therein, said housing being further characterized to include a retention bumper connected at said second end to aid in retaining the clipper such that nail clippings are prevented from escaping between said second end of said retainer and the jaws of the nail clipper when the nail clipper is disposed within said retainer.

5. The nail clipper retainer of claim 4, wherein said housing includes a grooved surface which is formed inside said housing to slidably receive the chain as the clipper is axially moved within said retainer.

6. The nail clipper retainer of claim 4, wherein said housing is further characterized to include a pair of retention bumpers, wherein one of said bumpers is connected to one of said sides at said second end and another of said bumpers is connected to another of said sides at said second end to aid in retaining the clipper and nail clippings from escaping between said bumpers and the jaws of the nail clipper when the nail clipper is disposed within said retainer.

* * * * *